US009198464B2

(12) United States Patent
Liu

(10) Patent No.: US 9,198,464 B2
(45) Date of Patent: Dec. 1, 2015

(54) ELECTRONIC CIGARETTE CASE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 100 days.

(21) Appl. No.: 13/959,390

(22) Filed: Aug. 5, 2013

(65) Prior Publication Data

US 2014/0299492 A1 Oct. 9, 2014

Related U.S. Application Data

(63) Continuation of application No. PCT/CN2013/073922, filed on Apr. 9, 2013.

(51) Int. Cl.

| | |
|---|---|
| ***A24F 15/00*** | (2006.01) |
| ***B65D 85/10*** | (2006.01) |
| ***B65D 85/12*** | (2006.01) |
| ***A24F 15/12*** | (2006.01) |
| *A24F 47/00* | (2006.01) |

(52) U.S. Cl.

CPC ..... *A24F 15/12* (2013.01); *A24F 47/008* (2013.01)

(58) Field of Classification Search

CPC ..... B01J 3/03; B60K 15/05; A24F 15/12
USPC ..... 206/264, 250, 268; 220/211; 131/187, 131/242

See application file for complete search history.

(56) References Cited

U.S. PATENT DOCUMENTS

| | | | | |
|---|---|---|---|---|
| 4,739,585 | A * | 4/1988 | Pickles | 49/280 |
| 5,065,884 | A * | 11/1991 | Naritomi et al. | 220/264 |
| 6,409,064 | B1 * | 6/2002 | Bayley | 224/404 |
| 2004/0258584 | A1 | 12/2004 | Choi et al. | |

FOREIGN PATENT DOCUMENTS

| | | | |
|---|---|---|---|
| CN | 101197250 | A | 6/2008 |
| CN | 201491713 | U | 6/2010 |
| CN | 102197973 | A | 9/2011 |

OTHER PUBLICATIONS

International Search Report for Application No. PCT/CN2013/073922 dated Jan. 16, 2014.

* cited by examiner

*Primary Examiner* — Luan K Bui
*Assistant Examiner* — Rafael Ortiz
(74) *Attorney, Agent, or Firm* — Tim Tingkang Xia, Esq.; Locke Lord LLP

(57) ABSTRACT

An electronic cigarette case is provided, comprising a case body and a case lid hinged with the case body via a rotating axis, a control unit configured in the case body, a driving motor and a switch which are electrically connected with the control unit, and a flipping mechanism. The switch is configured on the outside of the case body. One end of the flipping mechanism is connected to an output shaft of the driving motor, and the other end of the flipping mechanism is embedded into the case lid slidably. The driving motor is controlled by the control unit to drive the flipping mechanism to rotate towards the opening or closing direction, so as to open or close the case lid, thus automatically opening or closing the electronic cigarette case via the flipping mechanism and the control unit.

11 Claims, 4 Drawing Sheets

ELECTRONIC CIGARETTE CASE

CROSS-REFERENCE TO RELATED APPLICATIONS

This application is a continuation of International Patent Application No. PCT/CN2013/073922, with an international filing date of Apr. 9, 2013, designating the United States, now pending. The contents of these specifications are incorporated herein by reference.

FIELD OF THE INVENTION

The present invention relates to the field of electronic cigarette, more specifically, to an electronic cigarette case.

BACKGROUND OF THE INVENTION

At present, the electronic cigarette case in the market can be opened by 2 means: one is by manual labour, i.e., opening the case completely by hand without any flicking mechanism; the other is by an automatic opening spring mechanism, i.e., opening the case by the elastic force of the spring mounted on the rotating axis of the case lid. The former one has a defect that the case can't be opened or closed automatically by a flicking mechanism, thus being inconvenient. The later one adopts an automatic opening spring mechanism to provide the power for opening, but the structure is complex and it cannot open and close the case with uniform speed, thus not convenient in using.

SUMMARY OF THE INVENTION

The object of the present invention is to enable the case to be opened and closed with a uniform speed through providing a flipping mechanism, making it simple in structure and convenient in operation, aiming at the defects of complex structure and inconvenient operation in the prior art.

The technical solutions of the present invention for solving the technical problems are as follows.

An electronic cigarette case is provided, which comprises a case body, a case lid hinged with the case body by a rotating axis, a control unit set in the case body, a driving motor and a switch electrically connected to the control unit respectively, and a flipping mechanism.

The switch is mounted on the outside of the case body; one end of the flipping mechanism is connected to an output shaft of the driving motor, and the other end of the flipping mechanism is embedded into the case lid slidably; the driving motor is controlled by the control unit to drive the flipping mechanism to rotate towards the opening or closing direction, so as to open or close the case lid.

In the electronic cigarette case of the present invention, the flipping mechanism comprises a worm screw mounted on the output shaft of the driving motor, a gear engaged with the worm screw, and a curved bar, and the gear includes a gear rotating axis, a first end of the curved bar is sheathed on the gear rotating axis and will rotate along with the rotation of the gear, and a second end of the curved bar is attached to the inner side of the case lid slidably.

In the electronic cigarette case of the present invention, a curved bar chute is defined in the inner side of the case lid close to the rotating axis, and the second end of the curved bar is attached to the curved bar chute slidably and location-limited by the curved bar chute.

In the electronic cigarette case of the present invention, the curved bar includes a crank and a crank arm formed with the crank integrally; the crank is close to the first end and the terminal of the crank is sheathed on the gear rotating axis; the crank arm is close to the second end, configured as an arc whose radius is the crank, while the terminal of the crank arm is mounted in and attached to the curved bar chute.

In the electronic cigarette case of the present invention, a groove for limiting the location of the gear rotating axis is provided in the lid body, and the gear rotating axis is attached to the groove so as to prevent the location of the gear deviated during rotation.

In the electronic cigarette case of the present invention, a location-limited switch electrically connected to the control unit is configured in the case body, which can be triggered by the crank when the case lid is closed and then the driving motor can be controlled to stop rotating by the control unit.

In the electronic cigarette case of the present invention, the control unit is configured as a control printed circuit board with timing function, which can be used to control the driving motor to operate during a predetermined period when the case lid is opened and to stop rotating after the period has been exceeded.

In the electronic cigarette case of the present invention, a rotating axis is provided, a first hinge part is configured on the case lid, a second hinge part is configured on the case body; a first through hole is defined in the first hinge part, and, a second through hole which has a same axis with the first through hole is defined in the second hinge part; the rotating axis is inserted into the first and second through holes.

In the electronic cigarette case of the present invention, the first and second through holes are both matched with the rotating axis with gaps.

In the electronic cigarette case of the present invention, the first hinge part comprises an arc-shaped structure, and the first hinge part is contacted with the case body slidably when the case lid is opened or closed.

In the electronic cigarette case of the present invention, the gear is mounted between the worm screw and the inner surface of the case lid close to the worm screw.

By implementing the electronic cigarette case in the present invention, the following advantages can be achieved. A flipping mechanism comprising a control printed circuit board, a driving motor, a worm screw, a gear and a curved bar is provided in the electronic cigarette case. The driving motor is controlled by the control unit to motivate the worm screw to drive the gear, and further driving the curved bar to open or close the case lid with a uniform speed, thus enabling the case lid to be opened or closed automatically. This structure makes it possible that the case lid will be automatically opened or closed completely when the case lid has been opened or closed at just a very angle, and the case lid can be opened and closed with a uniform speed since the motor is rotating with a uniform speed to drive the curved bar to rotate with an even speed via the gear.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

Figure 1:
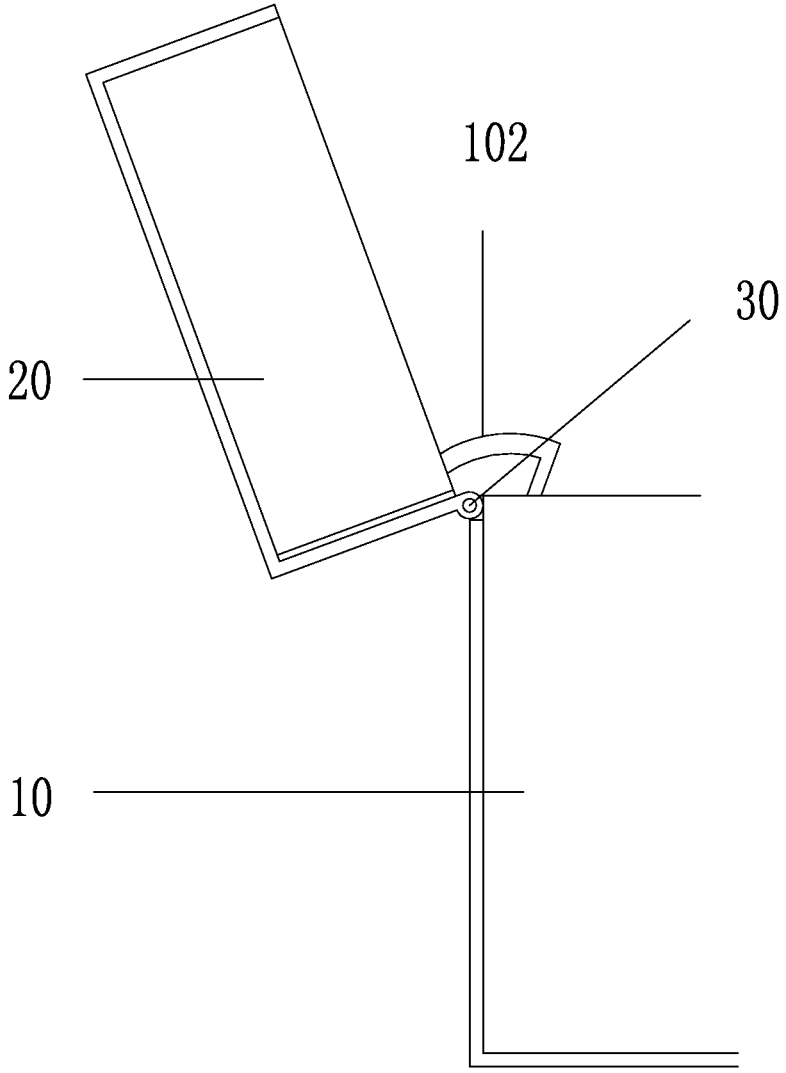
FIG. 1 illustrates a partial structure of an electronic cigarette case of the invention in accordance with a preferable embodiment.

As shown in FIG. 1, in the electronic cigarette case of the present invention, a case body 10 is hinged with the case lid 20 by a rotating axis 30, a first hinge part (not shown) is configured on the case lid, a second hinge part (not shown) is configured on the case body 10. A first through hole (not shown) is defined in the first hinge part, and a second through hole (not shown) which has a same axis with the first through hole is defined in the second hinge part. The rotating axis 30 is inserted into the first and second through holes, and the first and second through holes are both matched with the rotating axis with gaps. The first hinge part comprises an arc-shaped structure, and the first hinge part is contacted with the case body slidably when the case lid is opened or closed.

Figure 2:
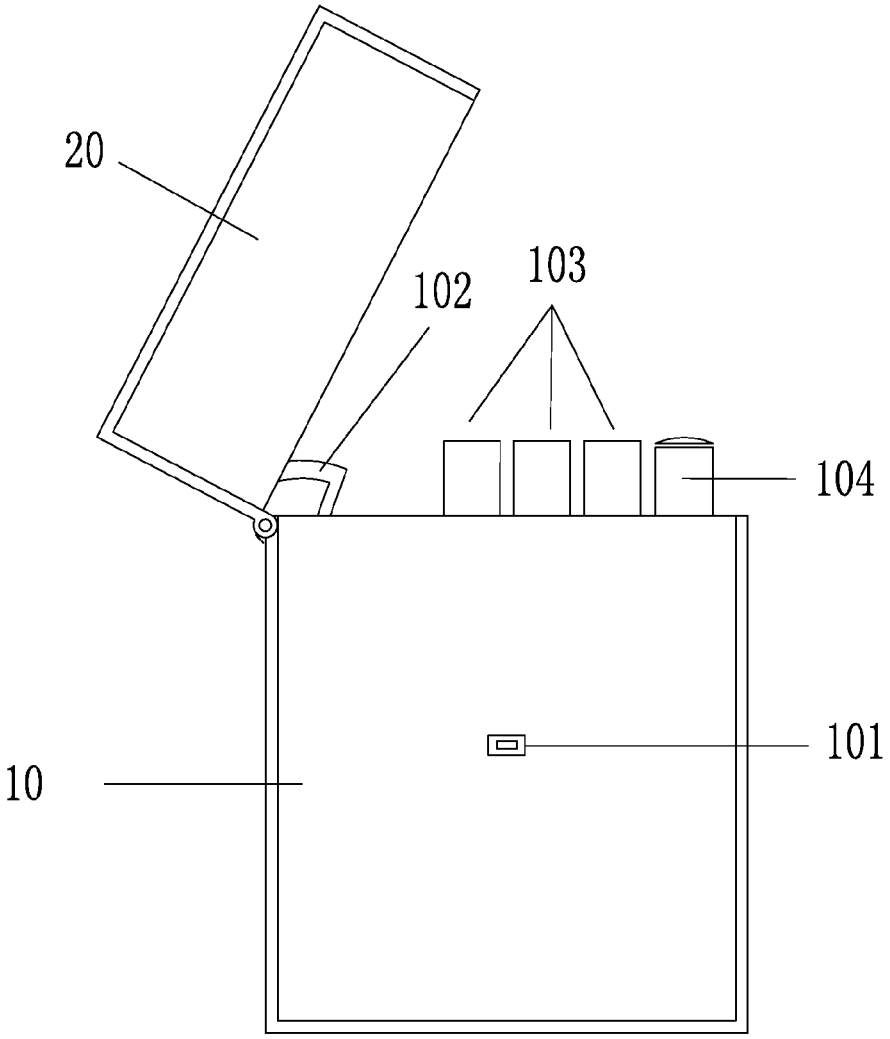
FIG. 2 illustrates a whole structure of the electronic cigarette case in FIG. 1.

As shown in FIG. 2, an electronic cigarette case in a first preferable embodiment of the present invention comprises a case body 10, a case lid 20 hinged with the case body 10 via a rotating axis 30, a control unit 105 configured in the case body 10, a driving motor 106 electrically connected to the control unit 105, a switch 101 configured on the outside of the case body 10 and electrically connected to the control unit 105, and a flipping mechanism (not shown).

Two ends of the flipping mechanism are separately connected to the driving motor 106 and the case lid 20. Wherein, one end of the flipping mechanism is connected to an output shaft of the driving motor 106, and the other end of the flipping mechanism is embedded into the case lid 20 slidably.

The driving motor 106 is controlled by the control unit 105 to drive the flipping mechanism to rotate towards the opening or closing direction, so as to open or close the case lid 20.

A battery seat for placing a battery 104 and an atomizer seat for placing an atomizer 103 are mounted in the case body 10. Advantageously, a backup battery is also configured in the case body 10 in the electronic cigarette case of the present invention to supply the control unit 105 in emergency cases. The control unit 105 can supply the battery 104 when connected to the battery 104 via a charging spring plate 110.

In the electronic cigarette case of the invention, a curved bar chute 201 is defined on the inner surface of the case lid adjacent to the surface where the first hinge part (not shown) resized in, and the curved bar chute 201 is perpendicular to the upper surface of the case lid.

Further, the flipping mechanism comprises a worm screw 107 mounted on the output shaft of the driving motor 106, a gear 108 engaged with the worm screw 107, and a curved bar 102. The gear 108 includes a gear rotating axis. The end of the curved bar 102 close to the worm screw 107 is regarded as a first end (not shown) which is sheathed on the gear rotating axis and will rotate along with the rotation of the gear 108. The other end of the curved bar 102 close to the case lid 20 is regarded as a second end which is attached to the inner side of the case lid 20 slidably.

Figure 3:
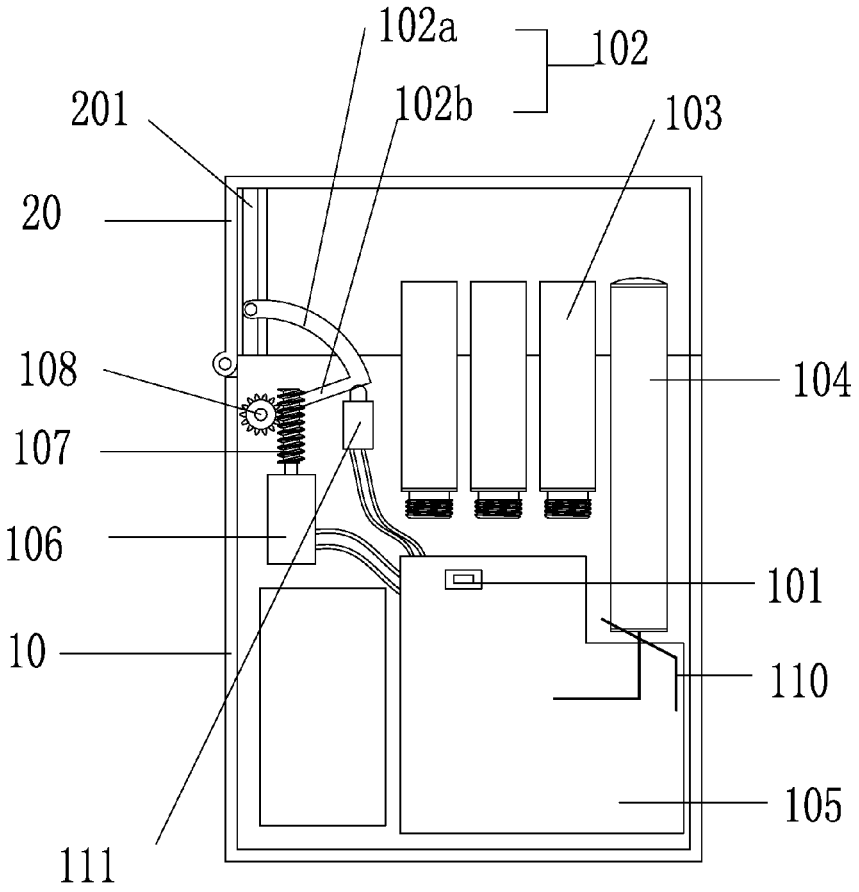
FIG. 3 illustrates a perspective view of the closing state of the electronic cigarette case in FIG. 2 with an atomizer and a battery pipe.
Figure 4:
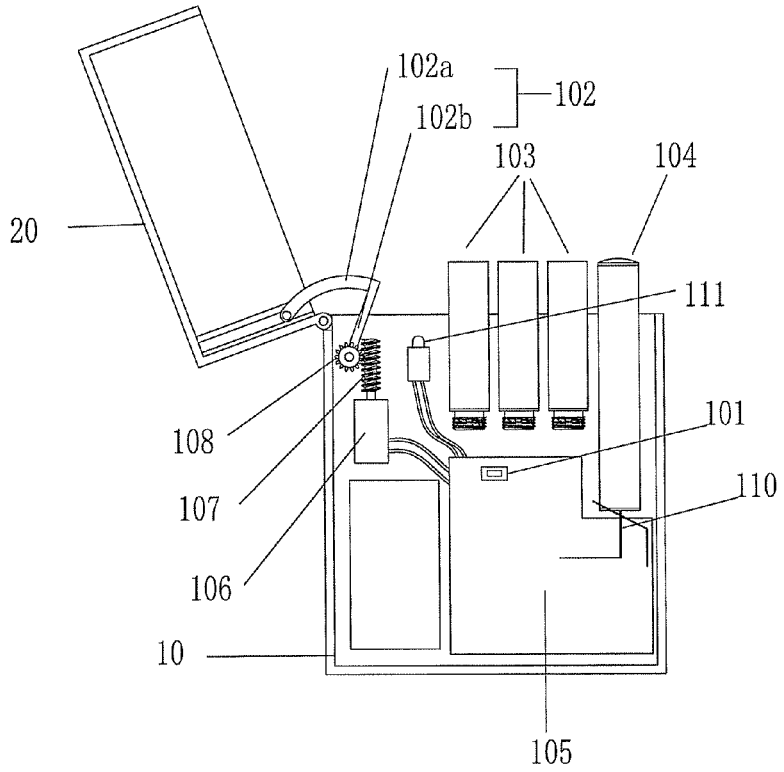
FIG. 4 illustrates a perspective view of the opening state of the electronic cigarette case in FIG. 2 with an atomizer and a battery pipe.

As show in FIG. 3-4, the curved bar 102 includes a crank 102*b* and a crank arm 102*a*. The crank 102*b* and the crank arm 102*a* are integrally formed so that the curved bar, consisted of the crank 102*b* and the crank arm 102*a*, only has two ends, i.e., the first end and the second end. The crank 102*b* is close to the first end (an end of the curved bar that close to the worm screw 107), with its terminal sheathed on the gear rotating axis of the gear 108. The crank arm 102*a* is close to the second end (an end of the curved bar that is close to the case lid 20), with its terminal embedded into the curved chute 201 and connected with the curved chute 201 slidably. In this embodiment, the crank arm 102*a* is configured as a section of arc whose center and radius is respectively the terminal of the crank 102*b* and the crank 102*b* itself, extending along the curved bar towards the case lid 20. The lengths of the crank 102*b* and the crank arm 102*a* are configured according to the practical cases. The curved bar 102 can be rotated along the motion of the curved bar 102.

In this embodiment, the gear 108 is configured between the worm screw 107 and the inner surface of the case body close to the worm screw 107, the gear 108 is engaged with the worm screw 107, and the rotating axis of the worm screw 107 is perpendicular to the rotating axis of the gear 108. The gear 108 will be driven to rotate along the gear rotating axis to power the curved bar to rotate when the worm screw 107 is rotating. Specifically, the number of normal modules of the worm screw 107 and that of the gear 108 are equal, in which case, the best driving effect can be achieved. The gear 108 is configured between the worm screw 107 and the inner surface of the case lid 10 close to the worm screw 107.

In this embodiment, the worm screw 107 is sheathed on the output shaft of the driving motor 106 and is driven by the driving motor to rotate with a uniform speed that can be configured according to practical situations. In this embodiment, the worm screw can be either a left hand one or a right hand one. Driven by the rotation of the worm screw 107, the gear 108 will rotate clockwise or counterclockwise, and with that the curved bar 102 connected to the gear rotating axis will rotate around the gear rotating axis clockwise or counterclockwise. As the terminal of the crank arm 102*a* of the curved bar 102 is attached into the curved bar chute 201 in the case lid 20, the terminal of the crank arm 102*a* is provided with an attaching part perpendicular to the curved bar chute, and the size of the attaching part fits with the curved bar chute 201.

Besides, in the case body 10 of the electronic cigarette case in the present invention, a location-limited switch 111 electrically connected with the control unit 105 is configured, and when the case lid 20 is closed, as is shown that, the crank 102*b* will contact the location-limited switch 111 as it is rotating clockwise, thus triggering the location-limited switch 111 to make the control unit 105 electrically connected to the location-limited switch 111 control the driving motor 106 to stop operation accordingly. The driving motor 106 then can be stopped efficiently in time, thus reducing power consumption and benefiting in extending the working life.

In the inner surface of the case body of the electronic cigarette case, a groove (not shown) can also be configured for limiting the location of the gear rotating axis (not shown), and the gear rotating axis is attached to the groove so as to prevent the gear 108 from deviating except for rotating when the gear 108 is rotating around the gear rotating axis.

FIG. 3 and FIG. 4 respectively correspond to the opening and closing state of the case lid 20 of the electronic cigarette case in the present invention. The specific opening and closing process are as follows.

The lid opening process is as follows: when the electronic cigarette case in the present invention is closed, the switch 101 on the outer shell of the case body is triggered to make the control unit 105 electrically connected to the switch 101 control to set up the driving motor 106, and the worm screw 107 configured on the output shaft of the driving motor 106 starts to rotate with a uniform speed, which is determined by the output power of the driving motor. Then the gear engaged with the worm screw 107 rotates counterclockwise, with its gear rotating axis (not shown) perpendicular to the rotating axis of the worn screw 107, and the gear rotating axis is fixed in the groove so as to keep the gear being relatively fixed. The curved bar 102 sheathed on the gear rotating axis rotates counterclockwise driven by the gear 108, and as the attaching part of the terminal of the curved bar 102*a* is configured on the inner surface of the case lid 20 close to the hinge parts of the case lid 20 and the case body 10, during the counterclockwise rotation, a torque along the opening direction will be produced on the case lid 10, thus driving the case lid 10 to rotate away from the case lid 10 along the rotating axis of the hinge parts to open the case lid. When the case lid is completely open, the control unit 105 controls the driving motor to stop operation.

The lid closing process is as follows: when the electronic cigarette case in the present invention is open, the switch 101 on the outer shell of the case body is triggered to make the control unit 105 electrically connected to the switch 101 control to set up the driving motor 106, and the worm screw 107 configured on the output shaft of the driving motor 106 starts to rotate with a uniform speed along a direction opposite to the direction of the worm screw 107 during the lid opening process, and the rotating speed is determined by the output power of the driving motor. Then the gear engaged with the worm screw 107 rotates clockwise, with its gear rotating axis (not shown) perpendicular to the rotating axis of the worm screw 107, and the gear rotating axis is fixed in the groove so as to keep the gear being relatively fixed. The curved bar 102 sheathed on the gear rotating axis rotates clockwise driven by the gear 108, and as the attaching part of the terminal of the curved bar 102*a* is configured on the inner surface of the case lid 20 close to the hinge parts of the case lid 20 and the case body 10, during the clockwise rotation of the curved bar, a torque along the closing direction will be produced on the case lid 10, thus driving the case lid 10 to rotate close to the case lid 10 along the rotating axis of the hinge parts, to close the case lid. Particularly, when the case lid is completely closed, the crank 102*b* of the curved bar 102 will finally be attached to the location-limited switch 111, for the control unit 105 electrically connected with the location-limited switch 111, when the location-limited switch 111 is pressed by the crank 102*b*, the control unit 105 will control the driving motor 106 to stop outputting.

Figure 5:
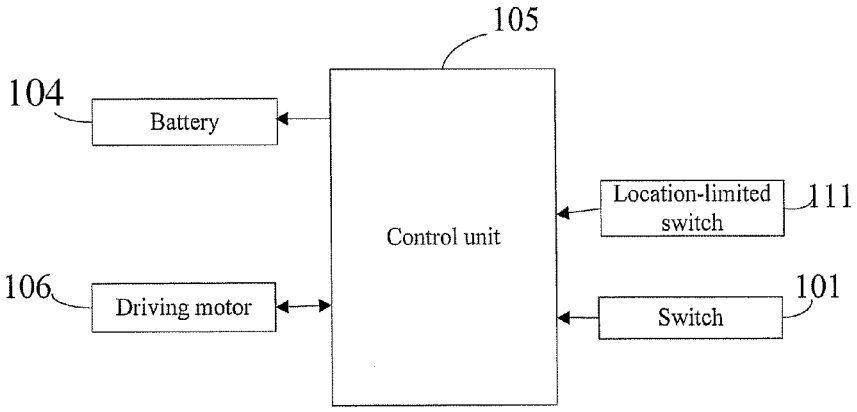
FIG. 5 illustrates electrically connected parts of the electronic cigarette case in FIG. 2.

As shown in FIG. 5, in the electronic cigarette case of the present invention, the control unit 10 is electrically connected with the location-limited switch 111, the switch 101, the battery 102 and the driving motor 106 separately, and particularly, the battery 104 is connected to the control unit 105 through a charging spring plate 110. When the switch 101 is triggered, the control unit will motivate the driving motor 106; when the location-limited switch 111 is triggered, the control unit 105 will control the driving motor to stop operation.

In a second preferable embodiment (not shown) of the invention, compared with the first embodiment, the difference is that the electronic cigarette case in the invention does not include the location-limited switch 111, while the length of the curved bar chute 201 can be configured according to the practical situations so that when opening or closing the case lid, the attaching part (not shown) may be moved right to the terminal of the curved bar chute 201. When the attaching part of the crank arm 102*a* of the curved bar 102 is slid right to the terminal of the curved bar chute 201, the control unit 105 will control the driving motor to stop operation In a third preferable embodiment of the electronic cigarette case of the present invention, the control unit (105) is configured as a control printed circuit board with timing function, and a timing unit (not shown) is configured in the control printed circuit board. When opening or closing the case lid, the control printed circuit board will control the driving motor 106 to operate in a predetermined period, and as long as the period is exceeded, the control printed circuit board will control the driving motor 106 to stop rotate.

In a forth preferable embodiment of the electronic cigarette case of the present invention, compared with the first embodiment, the difference is that, the flipping mechanism comprises a driving bar connected to the output shaft of the driving motor, and a transmitting bar partially that contacts with the driving bar all the time. One end of the transmitting bar is fixed in the case body in a rotatable way, while the other end is attached to the case lid, and the driving bar moves telescopically driven by the output power of the driving motor. When opening the case lid, the driving bar extending upward, pushing the transmitting bar that contacts with the driving bar, and the transmitting bar pushes the case lid to rotate away from the case body along the rotating axis so as to open the case lid; when closing the case lid, the driving bar retracts downward, and the transmitting bar falls back along the closing direction, thus closing the case lid.

While the present invention has been described with reference to preferred embodiments, it will be understood by those skilled in the art that various changes and equivalents may be substituted without departing from the scope of the present invention, and those various changes and equivalents shall fall into the protection of the invention.

What is claimed is:

1. An electronic cigarette case comprising a case body, a case lid hinged with the case body via a rotating axis, a control unit configured in the case body, a switch configured on the outside of the case body and electrically connected with the control unit, a location-limited switch configured in the case body and electronically connected with the control unit, a flipping mechanism, and a driving motor electrically connected with the control unit;

wherein, one end of the flipping mechanism is connected to a shaft of the driving motor, and the other end of the flipping mechanism is embedded into the case lid slidably; the driving motor is controlled by the control unit to drive the flipping mechanism to rotate towards the opening or closing direction, so as to open or close the case lid;

wherein, the electronic cigarette case is configured to accommodate an electronic cigarette comprising an atomization assembly and a battery assembly, a first seat and a second seat for respectively placing the atomization assembly and the battery assembly are defined in the case body, and the battery assembly is connected to and charged by the control unit via a spring plate when the battery assembly is placed in the second seat;

wherein, the flipping mechanism comprises a worm screw mounted on the shaft of the driving motor, a gear engaged with the worm screw, and a curved bar; the curved bar includes a straight portion and an arced portion formed with the straight portion integrally, the straight portion is connected to the gear, and the arced portion is attached to an inner side wall of the case lid slidably; and wherein, the curved bar is configured to press the location-limited switch when the case lid is closed and then the driving motor can be controlled to stop rotating by the control unit.

2. The electronic cigarette case of claim 1, wherein, a curved bar chute is defined in the inner side wall of the case lid close to the rotating axis, and the arced portion of the curved bar is attached to the curved bar chute slidably and location-limited by the curved bar chute.

3. The electronic cigarette case of claim 2, wherein, the straight portion is configured to be a radius of the arced portion.

4. The electronic cigarette case of claim 1, wherein, a groove for limiting the location of a gear rotating axis of the gear is provided in the case body, and the gear rotating axis is attached to the groove so as to prevent the location of the gear deviated during rotation.

5. The electronic cigarette case of claim 1, wherein, the control unit is configured as a control printed circuit board with timing function, which can be used to control the driving motor to operate during a predetermined period when the case lid is opened and to stop rotating after the period has been exceeded.

6. The electronic cigarette case of claim 1, wherein, a first hinge part is configured on the case lid, a second hinge part is configured on the case body; a first through hole is defined in the first hinge part, and, a second through hole which has a same axis with the first through hole is defined in the second hinge part; the rotating axis is inserted into the first and second through holes.

7. The electronic cigarette case of claim 6, wherein, the first through hole is matched with the rotating axis with a first gap, and the second through hole is matched with the rotating axis with a second gap.

8. The electronic cigarette case of claim 6, wherein, the first hinge part comprises an arc-shaped structure, and the first hinge part is contacted with the case body slidably when the case lid is opened or closed.

9. The electronic cigarette case of claim 7, wherein, the first hinge part comprises an arc-shaped structure, and the first hinge part is contacted with the case body slidably when the case lid is opened or closed.

10. The electronic cigarette case of claim 1, wherein, the gear is mounted between the worm screw and the inner surface of the case lid close to the worm screw.

11. The electronic cigarette case of claim 5, wherein, the gear is mounted between the worm screw and the inner surface of the case lid close to the worm screw.

* * * * *